US005947304A

United States Patent [19]

Thorp

[11] Patent Number: 5,947,304

[45] Date of Patent: Sep. 7, 1999

[54] MAGNETIC MOUNT MARKER HOLDER

[76] Inventor: Kelly R. Thorp, 1708 Cougar Ave., Norfolk, Va. 23518

[21] Appl. No.: 08/961,191

[22] Filed: Oct. 30, 1997

Related U.S. Application Data

[60] Provisional application No. 60/032,084, Dec. 3, 1996.

[51] Int. Cl.[6] ..... A47F 7/00

[52] U.S. Cl. ..... 211/69.5

[58] Field of Search ..... 211/69.5, 69.1, 211/60.1, 70.6; 248/206.5, 205.3

[56] References Cited

U.S. PATENT DOCUMENTS

| | | | |
|---|---|---|---|
| 1,899,509 | 2/1933 | Lapin . | |
| 2,297,806 | 10/1942 | Smith . | |
| 2,385,859 | 10/1945 | Jacobson . | |
| 2,389,292 | 11/1945 | Ellis . | |
| 2,862,626 | 12/1958 | Clare . | |
| 2,967,038 | 1/1961 | Lennemann . | |
| 3,150,296 | 9/1964 | McIntosh . | |
| 4,100,684 | 7/1978 | Berger . | |
| 4,415,092 | 11/1983 | Boyer . | |
| 4,736,853 | 4/1988 | O'Mara . | |
| 4,865,285 | 9/1989 | Gaggianese . | |
| 4,875,591 | 10/1989 | Mikesell . | |
| 5,000,327 | 3/1991 | Kincheloe | 211/69.5 |
| 5,232,103 | 8/1993 | Koenig et al. | 211/69.5 |
| 5,337,906 | 8/1994 | Digiulio . | |
| 5,368,203 | 11/1994 | Friedrich et al. . | |
| 5,544,764 | 8/1996 | Cima | 211/69.5 |

FOREIGN PATENT DOCUMENTS

| | | |
|---|---|---|
| 203395 | 5/1959 | Austria . |
| 1539160 | 8/1968 | France . |
| 1220799 | 1/1971 | United Kingdom . |

*Primary Examiner*—Alvin Chin-Shue
*Assistant Examiner*—Sarah Purol
*Attorney, Agent, or Firm*—Richard C. Litman

[57] ABSTRACT

A magnetic mount marker holder is disclosed for receiving a plurality of dry erase markers and positioning them in the proximity of a dry erase board or similar erasable surface. The holder includes a rigid frame member and a plurality of cavities which originate from the top surface thereof and extend into the frame member. The cavities are sized such that they may accommodate a plurality of writing implements. Means are also provided for securing the holder to a desired surface.

1 Claim, 2 Drawing Sheets

MAGNETIC MOUNT MARKER HOLDER

CROSS-REFERENCE TO RELATED APPLICATION

This application claims the benefit of U.S. Provisional patent application Ser. No. 60/032,084, filed Dec. 3, 1996.

BACKGROUND OF THE INVENTION

1. Field of the Invention

The present invention relates to writing implements and more particularly to writing implements designed for use with dry erase boards. The invention is specifically related to a dry erase marker which may be conveniently mounted in the proximity of any dry erase board.

2. Description of Prior Art

Dry erase boards are well known for providing a convenient and efficient method of temporarily writing information. Dry erase boards are commonly found in popular locations such as refrigerator doors, offices, hallways, and reception areas. A dry erase board is written upon with a felt-tipped pen which dispenses an ink that type, such that the writing may subsequently be erased. During the erasure process, the ink becomes a loose dust which is subsequently removed from the board by the eraser.

The use of dry erase boards has increased such that it has become common to find various sizes of dry erase boards which are suited for use in specific locations. In situations where a dry erase board is required for the large scale transfer of information such as a conference room, a horizontal ledge is typically provided directly beneath the board for receiving the pens and erasers. The use of such horizontal ledges has raised attention to several disadvantages. First, the corners of the ledge have a tendency to catch clothing and can sometimes result in injury when brushed against. Second, the ledges tend to collect the debris resulting from ordinary erasure in addition to ordinary dust. In an attempt to eliminate the forgoing disadvantages, many manufacturers of large scale boards have discontinued provision of a ledge. Smaller dry erase boards, on the other hand, have no provision for holding markers. Some manufacturers have provided clip-on devices for retaining a single marker. However, such devices are suited only for use with the original marker sold with the board and not third party markers. As a result of the foregoing, many users of dry erase boards have resulted to writing on the board with ordinary ink pens and pencils. Consequently, the surface of the board is quickly rendered useless.

The prior art discloses several types of holders for receiving writing implements. For example U.S. Pat. No. 1,899,509 issued on Feb. 28, 1933 to Lapin discloses an eraser and pencil holder attachment for typewriters. The holder includes a body which has a pair of flanges, one for securing it to a typewriter and the other for holding a pencil or the like. The holder also includes a pocket for receiving an eraser.

U.S. Pat. No. 2,297,806 issued on Oct. 6, 1942 to Smith discloses a magnetic holder for pencils or the like. The holder consists of a vacuum cup which is formed of resilient materials. A bar magnet which includes a flat smooth surface is secured to the cup such that the smooth surface faces away from the cup. A pair of oppositely disposed resilient fingers which are formed of non-magnetic materials is secured to the bar magnet. The fingers are normally biased against each other such that they may grip an article therebetween.

U.S. Pat. No. 2,385,859 issued on Oct. 2, 1945 to Jacobson discloses a magnetic attachment for articles of every day use. The device consists of a clip disposed at the non-writing end of a pencil or the like. The clip includes a sleeve which holds a magnet or may be provided with projections for engaging the recesses in a horse shoe magnet.

U.S. Pat. No. 2,862,626 issued on Dec. 2, 1958 to Clare discloses a holder for pencils, paper clips, and the like. The holder includes a flat back member which has a multiplicity of vertical tapered partitions extending at right angles to the back member. A front member is provided which includes a housing to enclose a receptacle for receiving paper clips or similar accessory items. Means are also provided for attaching the holder to a surface.

U.S. Pat. No. 3,150,296 issued on Sep. 22, 1964 to McIntosh discloses a portable magnetic memorandum device. The device includes a bendable plate which is made of magnetic material. An elongated strip of flexible magnetized magnetic material is disposed on one face of the plate. The magnetic strip has sufficient magnetic strength to hold the plate when the strip is positioned against the surface of an object made of ferrous material. A magnet may be attached to one end of a soft pencil or crayon so that it may be secured to the plate.

U.S. Pat. No. 4,100,684 issued on Jul. 18, 1978 to Berger discloses a holder device for paper articles and writing instruments. The device includes a housing which contains a pair of compartments therein. A permanent magnet is mounted on the housing and is removably received on a ferrous metallic bar which is mounted on a stationary object. An ejector assembly is provided in one of the compartments for ejecting the writing instruments.

U.S. Pat. No. 4,415,092 issued on Nov. 15, 1983 to Boyer discloses a holder for uniformly shaped articles. The holder is intended to hold a plurality of articles in individual storage chambers. Each article may then be removed without affecting the others. Furthermore, each article is automatically replaced by the article which manually displaces it from the holder.

U.S. Pat. No. 4,736,583 issued on Apr. 12, 1988 to O'Mara discloses a pen and pencil accessory holder. The holder includes a flexible fabric material, a flexible sheet of non-ferrous material, and permanently magnetized particles dispersed throughout the sheet. The holder allows convenient placement on and removal from ferromagnetic surfaces such as locker doors and refrigerator doors.

U.S. Pat. No. 4,875,591 issued on Oct. 24, 1989 to Mikesell discloses a marking board implement holder. The holder includes a number of partial cylindrical cavities for retaining respective markers and a separate trapezoidal cavity to retain an eraser. The cavities are designed such that they retain markers and erasers disposed therein. Adhesive strips are provided for securing the holder to a suitable mounting surface.

U.S. Pat. No. 4,865,285 issued on Sep. 12, 1989 discloses a magnetic penholder and magnetic pen set which includes a base having a curved surface. A magnet is disposed within the base with one pole facing upwards. The pen also includes a magnet therein which is attracted to the magnet of the base in such a manner that the pen rotates until an opposite pole is exposed and it attaches to the base.

U.S. Pat. No. 5,337,906 issued on Aug. 16, 1994 to Digiulio discloses a wall-mounted device for providing storage for and convenient access to secretarial items such as pens, pencils, writing pads, etc. The device may be mounted on any vertical surface and may be provided with a light in order to facilitate use thereof. An adhesive layer is used to secure the device to the mounting location.

U.S. Pat. No. 5,368,203 issued on Nov. 29, 1994 to Friedrich et al. discloses a spice rack with magnetically held spice containers. The spice rack includes a removable closure body which is detachably secured to a stationary tubular holder. The closure body is designed to hold a spice container via a magnet.

None of the above inventions and patents, taken either singularly or in combination, is seen to describe the instant invention as claimed. Thus a magnetic mount marker holder solving the aforementioned problems is desired.

SUMMARY OF THE INVENTION

Accordingly, it is a principal object of the invention to provide a holder for writing implements used in conjunction with dry erase boards.

It is another object of the invention to provide a holder for dry erase markers which may be easily stationed proximate the dry erase board.

It is an object of the invention to provide improved elements and arrangements thereof in a magnetic mount marker holder for the purposes described which is inexpensive, dependable and fully effective in accomplishing its intended purposes.

In accordance with the objects of the invention, a holder is provided for receiving a plurality of writing implements. The holder is comprised of a rigid frame member which includes a front surface, a rear surface, a top surface, and a bottom surface. A plurality of cavities originate from the top surface and extend into the frame member. The cavities are sized such that they may accommodate a plurality of writing implements. The holder is provided with means for securing it to a desired surface. In preferred embodiments of the invention, a strip of magnetic material is disposed on the rear surface of the holder. The magnetic material allows the holder to be conveniently mounted in the vicinity of most dry erase boards.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
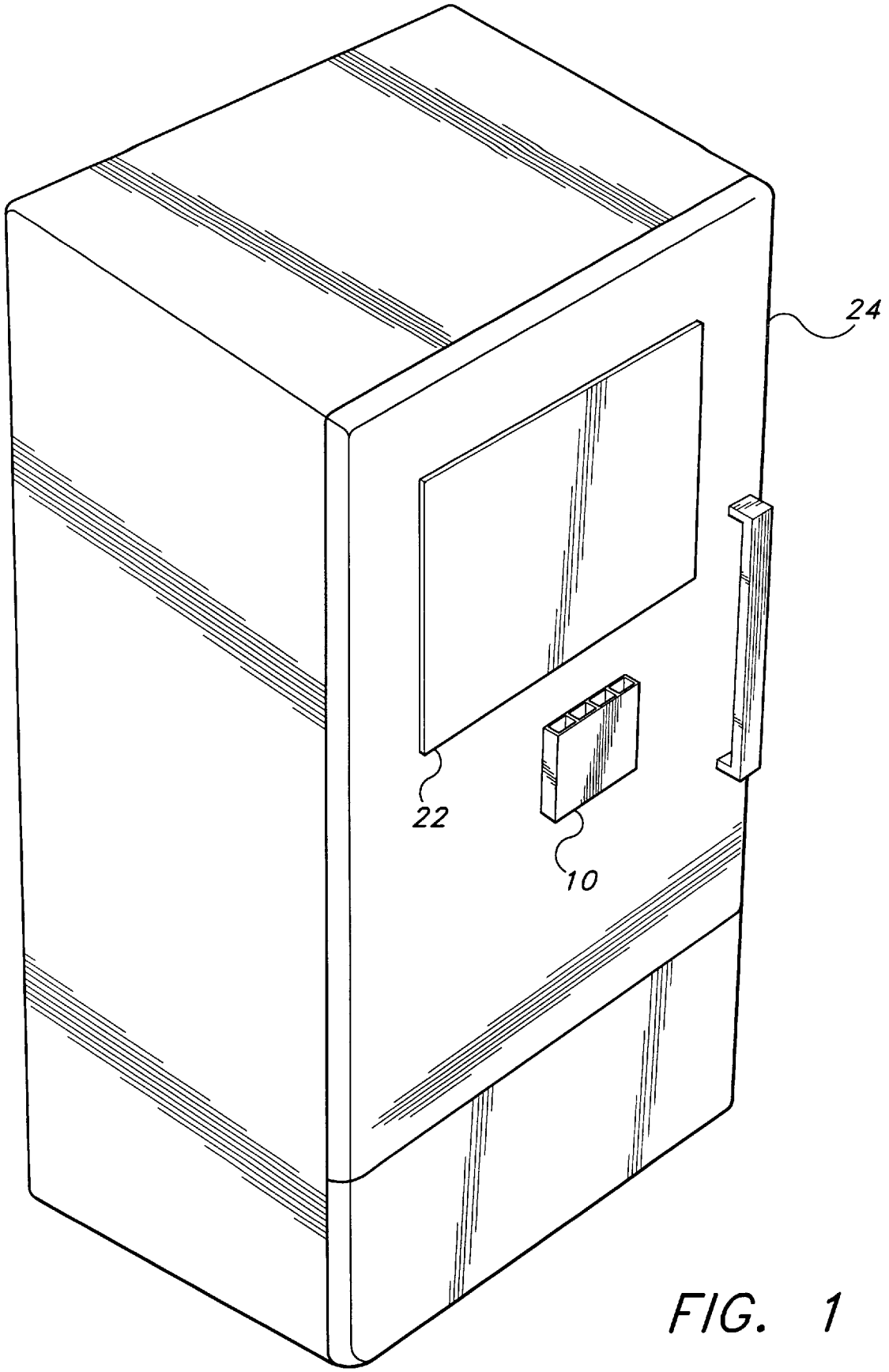
FIG. 1 is an environmental view of a magnetic mount marker holder in accordance with the present invention.
Figure 2:
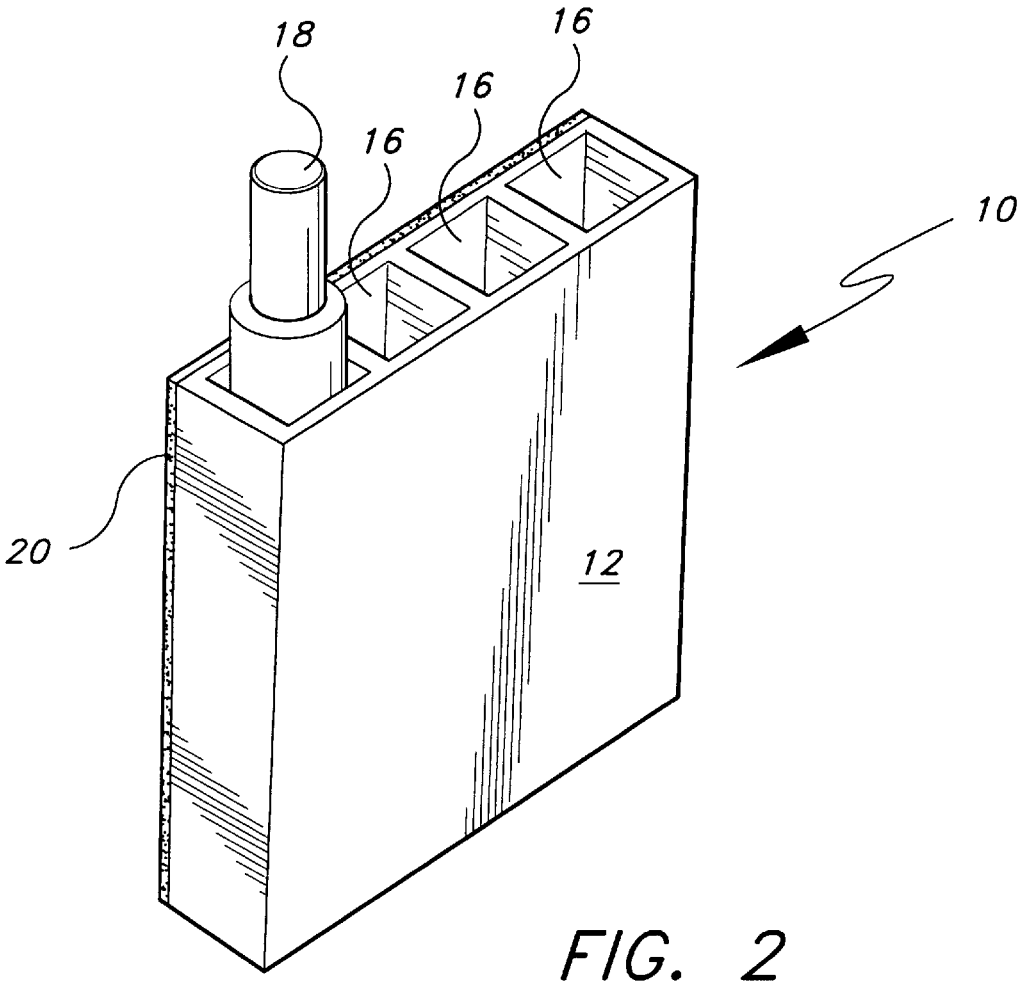
FIG. 2 is a perspective view of the magnetic mount marker holder.
Figure 3:
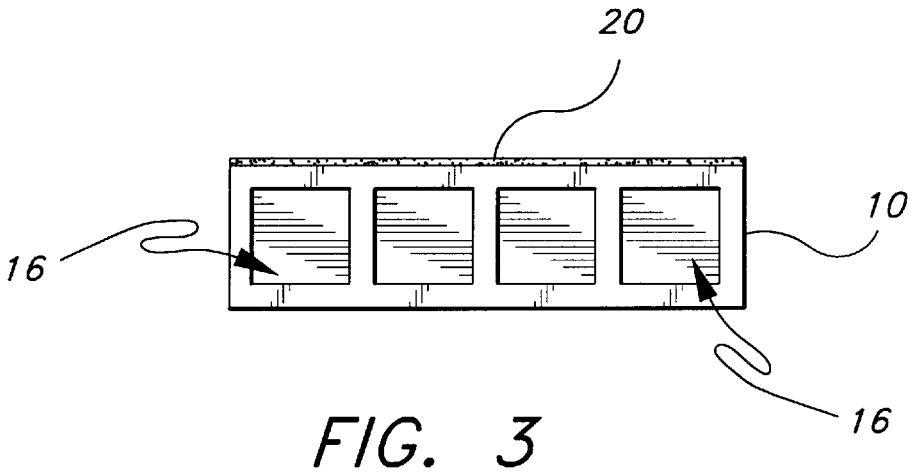
FIG. 3 is a top plan view of the magnetic mount marker holder.

With reference to the drawings and initially to FIG. 1, a marker holder 10 is shown mounted on the door of refrigerator 24 at a location proximate a dry erase board 22. The dry erase board 22 may be secured to the refrigerator 24 in many ways including magnetically. While the holder 10 is illustrated in connection with a dry erase board 22, it may be used to write on a variety of other surfaces including overhead transparencies. As seen with reference to FIGS. 2 and 3, the holder 10 is comprised of a rigid frame member 12 which includes a top surface. The holder 10 may be constructed of various materials, however lightweight materials such as plastics are preferred. Furthermore, the holder 10 may be designed to receive various types of writing implements in addition to the dry erase marker 18 illustrated in FIG. 2. A plurality of cavities 16 originate from the top surface and extend into the frame member 12. The cavities 16 are sized such that they may accommodate the dry erase markers 18 therein. The cavities 16 may contain various cross-sections, such as rectangular, circular, or oval, depending on the shape of the specific writing implement to be stored therein. A strip of magnetic 20 material is disposed on the rear surface of the holder 10 and secured thereto. The exposed surface of the magnetic material 20 allows the holder 10 to be conveniently positioned on any ferromagnetic surface or such surfaces which otherwise exhibit magnetic properties. Thus, the holder 10 is easily positioned in the vicinity of most dry erase boards 22 so that a user always has access to dry erase markers 18.

It is to be understood that the present invention is not limited to the embodiment described above, but encompasses any and all embodiments within the scope of the following claims.

I claim:

1. In combination, a plurality of dry erase marker writing implements and a holder for receiving the plurality of writing implements, said holder comprising:

a rigid frame member including a front surface, a rear surface, a top surface, and a bottom surface;

said rigid frame constructed from lightweight plastic materials;

a plurality of cavities disposed on said top surface and extending therethrough; and magnetic attraction means for selectively securing said holder to a desired surface, disposed entirely on said rear surface of said rigid frame member, said magnetic attraction means for securing including a magnetic strip means for producing an attraction between said rear surface of said rigid frame member and the desired surface.

* * * * *